US009850435B2

(12) United States Patent
Shih et al.

(10) Patent No.: US 9,850,435 B2
(45) Date of Patent: Dec. 26, 2017

(54) HYDROPROCESSING WITH DRUM BLANKETING GAS COMPOSITIONAL CONTROL

(71) Applicants: Stuart H. Shih, Gainesville, VA (US); William J. Novak, Bedminster, NJ (US)

(72) Inventors: Stuart H. Shih, Gainesville, VA (US); William J. Novak, Bedminster, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 206 days.

(21) Appl. No.: 14/809,911

(22) Filed: Jul. 27, 2015

(65) Prior Publication Data

US 2016/0060547 A1 Mar. 3, 2016

Related U.S. Application Data

(60) Provisional application No. 62/041,841, filed on Aug. 26, 2014.

(51) Int. Cl.

| | |
|---|---|
| ***C10G 45/02*** | (2006.01) |
| ***C10G 45/08*** | (2006.01) |
| ***C10G 65/04*** | (2006.01) |

(52) U.S. Cl.

CPC ..... *C10G 45/02* (2013.01); *C10G 45/08* (2013.01); *C10G 65/04* (2013.01); *C10G 2300/70* (2013.01); *C10G 2300/80* (2013.01)

(58) Field of Classification Search

CPC ..... C10G 45/02; C10G 45/08; C10G 65/04; C10G 2300/80; C10G 2300/70

See application file for complete search history.

(56) References Cited

U.S. PATENT DOCUMENTS

| | | | | |
|---|---|---|---|---|
| 4,131,537 | A | 12/1978 | Winter et al. | |
| 4,243,519 | A | 1/1981 | Schorfheide | |
| 4,518,487 | A * | 5/1985 | Graf | C10B 55/00 208/131 |
| 5,156,458 | A * | 10/1992 | Hemrajani | B01F 5/0609 261/123 |
| 5,853,570 | A | 12/1998 | Hatanaka et al. | |
| 5,906,730 | A | 5/1999 | Hatanaka et al. | |

(Continued)

FOREIGN PATENT DOCUMENTS

| | | | |
|---|---|---|---|
| WO | 03048273 | A1 | 6/2003 |
| WO | 03099963 | A1 | 12/2003 |

OTHER PUBLICATIONS

J.P. Greeley, S. Zaczepinski, T.R. Halbert, G.B. Brignac, A.R. Gentry and S. Mayo, "Selective Cat Naphtha Hydrofining with Minimal Octane Loss", National Petroleum & Refiners Association, Paper No. AM-99-31, 1999.

*Primary Examiner* — Randy Boyer
*Assistant Examiner* — Juan Valencia
(74) *Attorney, Agent, or Firm* — Andrew T. Ward

(57) ABSTRACT

A catalytic naphtha hydrodesulfurization process is operated in a process unit having a surge drum with equipped for gas blanketing with a blanketing gas containing controlled levels of CO and $CO_2$. If the gas selected for blanketing normally contains more than the acceptable level of these inhibitors, they should be reduced to the levels appropriate for retention of catalyst functionality.

8 Claims, 1 Drawing Sheet

(56) References Cited

U.S. PATENT DOCUMENTS

| | | | | |
|---|---|---|---|---|
| 5,985,136 | A | 11/1999 | Brignac et al. | |
| 6,013,598 | A | 1/2000 | Lapinski et al. | |
| 6,231,753 | B1 | 5/2001 | McKnight et al. | |
| 6,231,754 | B1 | 5/2001 | Brignac et al. | |
| 6,387,249 | B1 | 5/2002 | Cook et al. | |
| 6,409,913 | B1 | 6/2002 | Clark et al. | |
| 6,596,157 | B2 | 7/2003 | Gupta et al. | |
| 2003/0221994 | A1* | 12/2003 | Ellis | B01J 23/882 208/213 |
| 2007/0114156 | A1 | 5/2007 | Greeley et al. | |
| 2012/0241360 | A1 | 9/2012 | Ross et al. | |
| 2014/0174982 | A1 | 6/2014 | Umansky et al. | |

* cited by examiner

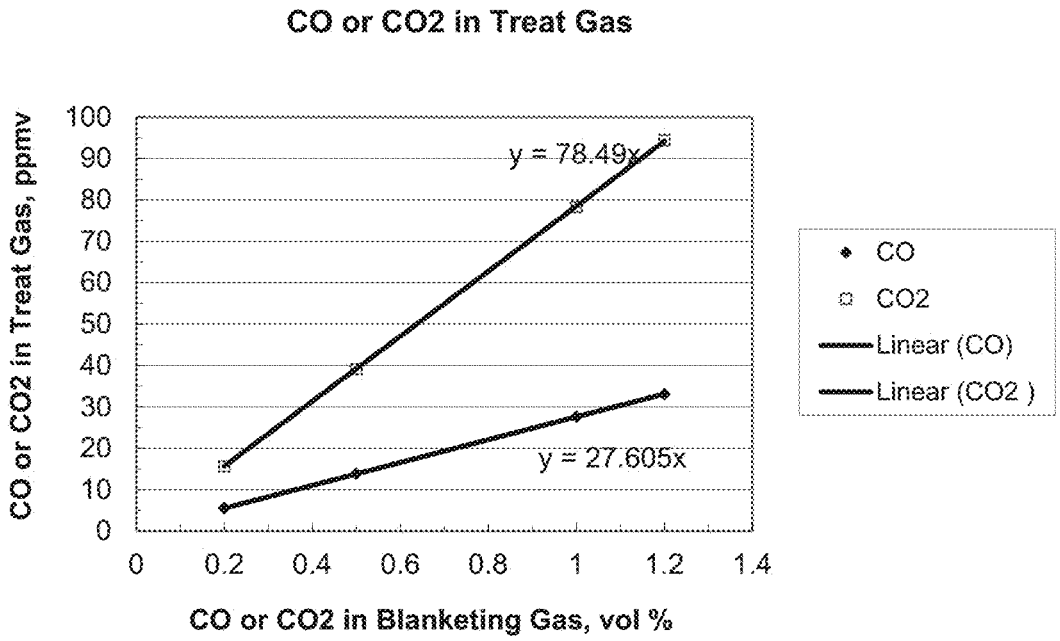
CO or CO2 in Treat Gas
CO or CO2 in Treat Gas, ppmv
100
90
80
70
60
50
40
30
20
10
0
0
0.2
0.4
0.6
0.8
1
1.2
1.4
CO or CO2 in Blanketing Gas, vol %
y = 78.49x
y = 27.605x
CO
CO2
Linear (CO)
Linear (CO2 )

HYDROPROCESSING WITH DRUM BLANKETING GAS COMPOSITIONAL CONTROL

CROSS-REFERENCE TO RELATED APPLICATIONS

This application claims priority to U.S. Provisional Application Ser. No. 62/041,841 filed Aug. 26, 2014, herein incorporated by reference in its entirety.

FIELD OF THE INVENTION

This invention relates to a method for hydroprocessing petroleum fractions, especially naphtha boiling range fractions, with control over the blanketing gas used in the processing.

BACKGROUND OF THE INVENTION

Many petroleum fractions used for the manufacture of fuels and in petrochemicals processes often contain organic sulfur and nitrogen compounds as contaminants. To comply with relevant regulatory standards for fuels, these fractions need to be reduced to lower levels. Reduction of these contaminants is also required when the fractions are to be treated in subsequent refining processes if the presence of these contaminants in the feed leads to poisoning of the catalysts used in the processes. Reforming and isomerization, for example, typically demand no more than 10 ppmw sulfur in the feed and many catalyst manufacturers recommend no more than 1 ppmw with certain types of catalyst.

A common feature of petroleum processing equipment is the surge drum which is a vessel designed to accommodate differences between the rate at which a fraction is received in the unit (or part of it) and the instantaneous rate at which it is to be fed to subsequent processing steps. With hydrocarbon streams, it is the general practice to carry out some form of inerting under mild positive pressure in order to preclude entry of outside air with its consequent risk of explosion. A number of inerting or blanketing gases are available, for example, nitrogen, and in many petroleum refineries natural gas or refinery fuel gas provides a readily available and convenient blanketing gas. Some of these gases have, however, been found to have undesirable effects on processing with certain catalysts, particularly those containing catalytically active metals.

Among the catalysts susceptible to deactivation are those used in the ExxonMobil selective naphtha hydrofining process, SCANfining™, developed for deep hydrodesulfurization of catalytically cracked naphthas with maximum preservation of the olefins (octane). With this process it has been found, as noted in US2012/0241360, that the presence of carbon monoxide (CO), carbon dioxide ($CO_2$) or mixtures of the two may inhibit the action of the catalyst(s). If these gases are present in minor amounts the catalysts will still function satisfactorily but if they are present in excessive quantities, they will inhibit the desulfurization activity of the catalysts. Since the inhibition is less significant on the olefin saturation reaction, the presence of CO and $CO_2$ in the treat gas results in an increased octane loss as a higher degree of olefin saturation will take place as conditions are modified to achieve a constant level of desulfurization resulting a higher olefin saturation which increases the octane loss and decreases product quality. Table 1 below illustrates the effect of carbon monxide on the catalyst normally used in the process.

TABLE 1

CO inhibition on SCANfining Catalyst Performance

| | CO concentration in treat gas | |
|---|---|---|
| Catalyst Activity Reduction, % | 30 ppmv | 45 ppmv |
| Desulfurization Reaction | 33 | 40 |
| Olefin-Saturation Reaction | 18 | 20 |

A similar effect can be applied to $CO_2$ since CO and $CO_2$ will be in the equilibrium state governed by the water gas shift reaction. The CO+$CO_2$ concentration in the treat gas should be as low as possible, preferably less 10 ppmv to minimize their inhibition of the catalytic reactions.

While the CO+$CO_2$ composition of the treat gas is generally maintained by keeping the make-up hydrogen purity within tightly controlled limits to ensure proper functioning of the catalysts, the composition of the blanketing gas in the surge drum(s) has not previously been considered to be a significant factor in process design. However, as a result of investigation, it has been shown that the CO and $CO_2$ in the blanketing gas may dissolve in the liquid feed stream and so come into contact with the catalyst to the detriment of catalyst activity. Accordingly, it is necessary to define acceptable levels of these gases in the blanketing gas and provide methods for their control.

SUMMARY OF THE INVENTION

According to the present invention, a catalytic naphtha hydrodesulfurization process such as the SCANfining process is operated in a process unit having a surge drum with equipped for gas blanketing with a blanketing gas containing controlled levels of CO and $CO_2$. If the gas selected for blanketing normally contains more than the acceptable level of these inhibitors, they should be reduced to the levels described below or alternative blanketing gases used.

The selective catalytic naphtha hydrodesulfurization process is therefore operated in the presence of a hydrogen-containing treat gas in a process unit having a surge drum equipped for gas blanketing; the naphtha feed is blanketed in the surge drum with a blanketing gas containing CO and/or $CO_2$ at concentrations which result in concentrations of CO and/or $CO_2$ dissolved in the naphtha at which the activity of the catalyst of the hydrodesulfurization process is maintained.

The progressive sequence of steps for maintaining functionality of the catalyst comprises:

i. determining the concentrations of CO and $CO_2$ in the blanketing gas;
ii. determining the concentrations of CO and $CO_2$ in the treat gas appropriate for retention of catalyst functionality in the hydrodesulfurization;
iii. determining the concentrations of CO and $CO_2$ in the blanketing gas corresponding to the operational concentrations of CO and $CO_2$ in the treat gas appropriate for retention of catalyst functionality;
iv. blanketing the naphtha feed in the surge drum with a blanketing gas containing CO and/or $CO_2$ at concentrations which result in concentrations of CO and/or $CO_2$ in the corresponding to the operational concentrations of CO and $CO_2$ in the treat gas appropriate for retention of catalyst functionality in the hydrodesulfurization.

If needed, the concentrations of CO and $CO_2$ in the blanketing gas are reduced to levels at which catalyst functionality in the hydrodesulfurization step is maintained at the acceptable level by removing the excess amounts from the blanketing gas. Under typical operating conditions, the total concentration of CO and/or $CO_2$ when natural gas is used as the blanketing gas is not more than about 0.4 vol5 and more preferably not more than 0.2 vol %.

DRAWINGS

The single figure of the accompanying drawings represents the results of the simulation studies reported below in the Examples.

DETAILED DESCRIPTION

Catalytic Treatment Processes

Olefin retentive selective catalytic naphtha hydrodesulfurization processes to which the present blanketing gas control techniques are potentially applicable include those described in U.S. Pat. Nos. 5,853,570; 5,906,730; 4,243,519; 4,131,537; 5,985,136 and 6,013,598 (to which reference is made for descriptions of such processes).

The hydrodesulfurization (HDS) of naphtha feeds is carried out in a process which in which sulfur is hydrogenatively removed while retaining olefins to the extent feasible. The HDS conditions needed to produce a hydrotreated naphtha stream which contains non-mercaptan sulfur at a level below the mogas specification as well as significant amounts of mercaptan sulfur will vary as a function of the concentration of sulfur and types of organic sulfur in the cracked naphtha feed to the HDS unit. Generally, the processing conditions will fall within the following ranges: 250-325° C. (about 475-620° F.), 1000-3500 kPag (about 150-500 psig) total pressure, 600-2500 kPa (about 90-350 psig kPa) hydrogen partial pressure, 200-300 Nm3/m3 hydrogen treat gas rate, and 1-10 hr.−1 LHSV.

SCANfining™ Process

The present method of monitoring and controlling the composition of the blanketing gas is particularly applicable to the SCANfining catalytic naphtha hydrodesulfurization process which optimizes desulfurization and denitrogenation while retaining olefins for gasoline octane. This process, which is commercially available under license from Exxon-Mobil Research and Engineering Company, incorporates aspects of the processes described in the following patents: U.S. Pat. Nos. 5,985,136; 6,231,753; 6,409,913; 6,231,754; 6,013,598; 6,387,249 and 6,596,157. SCANfining is also described in National Petroleum Refiners Association Paper AM-99-31 titled "Selective Cat Naphtha Hydrofining with Minimal Octane Loss".

The operation of the SCANfining process relies on a combination of a highly selective catalyst with process conditions designed to achieve hydrodesulfurization with minimum olefin saturation. The process may be operated either in a single stage or two stage with an optional mercaptan removal step following the hydrodesulfurization to remove residual mercaptans to an acceptable level, possibly permitting the hydrodesulfurization stage or stages to be operated at lower severity while still meeting sulfur specifications. The single stage version of the SCANfining process can be used with a full range catalytic naphtha or with an intermediate catalytic naphtha (ICN), for example a nominal 65-175° C. (150-350° F.) or a heavy catalytic naphtha (HCN), for example, a nominal 175° C.+(350° F.+) naphtha, or both. The two-stage version of the process, as described in U.S. Pat. No. 6,231,753, WO 03/048273 and WO 03/099963, adds a second reactor and inter-stage removal of $H_2S$ allowing very deep HDS with very good olefin retention. Suitable mercaptan removal processes are described in US 2007/114156 and US 2014/174982.

Typical SCANfining conditions in the one and two stage processes react the feedstock in the first reaction stage under hydrodesulfurization conditions in contact with a catalyst comprised of about 1 to 10 wt. % $MoO_3$; and about 0.1 to 5 wt. % CoO; and a Co/Mo atomic ratio of about 0.1 to 1.0; and a median pore diameter of about 6 to 20 nm; and a $MoO_3$ surface concentration in g $MoO_3/m^2$ of about $0.5–10^{-4}$ to $3\times10^{-4}$; and an average particle size diameter of less than about 2.0 mm. The reaction product of the first stage may then be optionally passed to a second stage, also operated under hydrodesulfurization conditions, and in contact with a catalyst comprised of at least one Group VIII metal selected from Co and Ni, and at least one Group VI metal selected from Mo and W, preferably Mo, on an inorganic oxide support material such as alumina. The preferred catalyst is the Albemarle Catalyst RT-235.

In a preferred two-stage SCANfining process configuration, typical process conditions will contact the naphtha with hydrogen over the first hydrotreating catalyst in the vapor phase to remove at least 70 wt. % of the sulfur, to produce a first stage effluent which is cooled to condense the naphtha vapor to liquid which contains dissolved $H_2S$ which is then separated from the $H_2S$ containing gas. The first stage naphtha reduced in $H_2S$ is then passed with hydrogen treat gas into the second vapor phase stage in the presence of a hydrodesulfurization catalyst at a temperature at least 10° C. (about 20° F.) greater than in the first stage and at a space velocity at least 1.5 times greater than in the first stage, to remove at least 80 wt. % of the remaining sulfur from the naphtha and form a desulfurized naphtha vapor. The second stage vapor effluent is then cooled to condense and separate the naphtha from the $H_2S$ to form a desulfurized naphtha product liquid which contains less than 5 wt. % of the amount of the sulfur present in the feed but retaining at least 40 vol. % of the olefin content of the feed. In this configuration, the catalyst in both stages comprising Co and Mo on a support and present in an amount of less than a total of 12 wt. % calculated as the respective metal oxides CoO and $MoO_3$ with a Co to Mo atomic ratio from 0.1 to 1.0. Reaction conditions in each stage normally range from 230-400° C. (about 450-750° F.), a pressure of from 400-34000 kPag (about 60-600 psig), a treat gas ratio of from 1000-4000 scf/b and a space velocity of from 1-10 v/v/hr; under these conditions, the percent desulfurization in the second stage is typically at least 90%. Space velocity in the second will normally be greater than that in the first stage and can range up to 6 $hr.^{-1}$ LHSV.

Table 2 below shows typical SCANfining reactor operating conditions.

TABLE 2

SCANfiner Reactor Operating Conditions

| | | |
|---|---|---|
| Total Exotherm | ° C. | 24 |
| Reactor Inlet Pressure | barg | 19.0 |
| Treat Gas Rate | Nm3/m3 | 253 |
| Treat Gas Purity | vol % H2 | 94.0 |
| Desulfurization | % HDS | 83.0 |
| Olefin Saturation | % OSAT | 15.4 |

Blanketing Gas

The present invention is applicable to catalytic refining processes in which a hydrocarbon feed stream, especially a naphtha fraction, is treated over a catalyst in a processing unit in which, at some point prior to the catalytic treatment, the feed stream is passed through a vessel or drum in which the held under a blanketing gas. The composition of the blanketing gas is monitored and controlled to maintain the total concentration of the carbon monoxide and carbon dioxide in the blanketing gas at a value resulting in a dissolved $CO/CO_2$ level in the stream equivalent to no more than 30 ppmv total $CO/CO_2$ in the treat gas stream. As shown below, the level of $CO/CO_2$ content in the blanketing gas can be empirically related to an equivalent level of these contaminants in the treat gas. If the proportion of CO and/or $CO_2$ in the blanketing gas exceeds the value(s) equivalent to 30 ppmv total in the treat gas stream, appropriate control measures are taken to ensure continued catalyst functioning.

Natural gas is available in many refineries and may be considered as a potential blanketing gas. Table 3 shows a typical natural gas composition.

TABLE 3

| Typical Natural Gas Composition Composition, vol % | |
|---|---|
| $N_2$ | 1.4 |
| CO | Trace |
| $CO_2$ | 1.2 |
| $CH_4$ | 93.1 |
| $C_2H_6$ | 3.2 |
| $C_3H_8$ | 0.7 |
| $C_4H_{10}$ | 0.4 |

Natural gas can contain as high as 2 vol % $CO_2$ or even higher, some of which can dissolve in the FCC naphtha. CO also may dissolve in the naphtha when used as a blanketing gas.

Determination of Acceptable $CO/CO_2$ Levels in Blanketing Gas

It has been found that under the conditions prevailing in the surge drum of the

SCANfining process, components of the blanketing gas become dissolved in the naphtha feed stream to an extent varying with pressure and temperature. If the dissolved components such as CO and $CO_2$ undesirably inhibit catalyst functioning, selection of an alternative blanketing gas becomes appropriate or, alternatively, the selected blanketing gas may be treated e.g. by absorption, adsorption or even by washing with a suitable solvent for the deleterious component(s). CO may be removed, for example, by absorption in a soda-lime bed and $CO_2$ may be removed by adsorption in a molecular sieve such as zeolite 4A.

The extent to which the CO and $CO_2$ need to be removed may be determined empirically. A suitable sequence is to use the PRO II simulation (SimSci, Invensys) to predict the permissible concentrations of these gases under appropriate processing conditions. For any known combination of naphtha feed composition, catalyst properties, process conditions, the concentrations of CO and $CO_2$ in the blanketing gas which will result in the maintenance of catalyst activity, especially hydrodesulfurization activity relative to olefin saturation activity will be determined and the blanketing gas composition controlled accordingly.

EXAMPLE 1

For the purposes of demonstrating the technique by which acceptable levels of CO and $CO_2$ in the blanketing gas can be determined, a typical FCC naphtha feed was selected having the composition set out in Table 3 below in order to simulate the CO and $CO_2$ solubilities in the naphtha under surge drum conditions.

TABLE 3

| FCC Naphtha Properties | |
|---|---|
| API Distillation, ° C. | 62.3 |
| IBP | 65 |
| 10 wt % | 73 |
| 30 wt % | 81 |
| 50 wt % | 95 |
| 70 wt % | 133 |
| 90 wt % | 197 |
| EP | 223 |

A PRO-II simulation was conducted under the conditions shown in Table 5 below.

TABLE 5

| Feed Surge Drum Conditions | |
|---|---|
| Pressure, bar | 3.4 |
| Temperature, ° C. | 37.8 |
| Blanketing Gas/Naphtha Ratio ($Sm^3/m^3$) | 3.4 |

The simulation assumed the use of the natural gas of Table 3 as the blanketing gas. $CO_2$ dissolved in this FCC naphtha was 0.00948 wt % that was equivalent to 94 ppmv $CO_2$ in the treat gas (based on treat gas/naphtha ratio of 338 $Sm^3/m^3$) which is much higher than the 30 ppmv total $CO/CO_2$ concentration allowable in the treat gas.

EXAMPLE 2

To determine the CO or $CO_2$ concentration allowable in the blanketing gas, the Pro-II simulation was extended to various CO and $CO_2$ concentrations in the blanketing gas using the natural gas composition shown in Table 1 as the base case. For simplicity, the methane concentration was varied according to total $CO/CO_2$ concentration in the simulated blanketing gas. The simulation conditions were the same as Table 6. The treat gas/naphtha ratio was the same: 338 $Sm^3/m^3$ and the blanketing gas/naphtha ratio 3.4 $Sm^3/m^3$.

The results are summarized in Table 6.

TABLE 6

| Simulation Results | | | | | |
|---|---|---|---|---|---|
| CO in Blanketing | vol % | 1.2 | 1 | 0.5 | 0.2 |
| CO2 in Blanketing Gas | vol % | 1.2 | 1 | 0.5 | 0.2 |
| CH4 in Blanketing Gas | vol % | 91.9 | 92.3 | 93.3 | 93.9 |
| Other Gases in Blanketing Gas (as in Table 2) | | | | | |
| Dissolved CO in Naphtha | wt % | 0.00289 | 0.00241 | 0.00121 | 0.000484 |
| Dissolved CO2 in Naphtha | wt % | 0.00948 | 0.00786 | 0.00393 | 0.00157 |
| CO2 in Treat Gas Equivalent | ppmv | 33 | 28 | 14 | 6 |
| CO in Treat Gas Equivalent | ppmv | 94 | 78 | 39 | 16 |

TABLE 6-continued

| Simulation Results | | |
|---|---|---|
| Conditions | | |
| Pressure | bar | 3.4 |
| Temperature | C. | 37.8 |
| Blanketing Gas/Naphtha Ratio | Sm3/m3 | 3.4 |
| Treat Gas/Naphtha Ratio | Sm3/m3 | 338 |

FIG. 1 illustrates these results graphically.

The results showed that the maximum allowable total $CO+CO_2$ concentration in the blanketing gas with this naphtha composition and natural gas composition under the conditions assumed for the determination should be less 0.4 vol % and better, less than 0.2 vol %. If a blanketing gas contains both CO and $CO_2$, Table 6 or FIG. 1 can be used to determine the individual allowable CO and $CO_2$ concentrations in the blanketing gas.

The invention claimed is:

1. A selective catalytic naphtha hydrodesulfurization process operated in the presence of a hydrogen-containing treat gas in a process unit having a surge drum equipped for gas blanketing, which comprises blanketing the naphtha in the surge drum with a blanketing gas containing CO and/or $CO_2$ at concentrations which result in concentrations of CO and/or $CO_2$ in the naphtha at which the activity of a catalyst of the hydrodesulfurization process is maintained, wherein the catalyst comprises about 1 to 10 wt. % Mo03; 0.1 to 5 wt. % CoO; a Co/Mo atomic ratio of about 0.1 to 1.0; and a median pore diameter of about 6 to 20 nm; a $Mo0_3$ surface concentration in g $Mo0_3/m^2$ of 0.5×10-4 to 3×10-4; and an average particle size diameter of less than about 2.0 mm; and wherein the process is carried out in a two stage process in which the naphtha boiling range feed is contacted with hydrogen over a first hydrotreating catalyst in the vapor phase to remove at least 70 wt. % of the sulfur, to produce a first stage effluent which is cooled to condense the naphtha vapor which is then separated from the $H_2S$ containing gas and passed with hydrogen into the a second vapor phase stage at a temperature at least 10° C. greater than in the first stage and at a space velocity at least 1.5 times greater than in the first stage, to remove at least 80 wt. % of the remaining sulfur from the naphtha and form a desulfurized naphtha vapor.

2. A process according to claim 1 in which the blanketing gas excludes natural gas.

3. A process according to claim 1 in which the olefin-retentive hydrodesulfurization is carried out at a temperature of 250-325° C., a total system pressure of 1000-3500 kPag, a hydrogen partial pressure of 600-2500 kPa and 1-10 $hr^{-1}$ LHSV.

4. A process according to claim 1 in which the effluent of the second stage comprises a naphtha which contains less than 5 wt. % of the amount of sulfur present in the feed but retaining at least 40 vol. % of the olefin content of the feed.

5. A process according to claim 1 in which the catalyst in both stages comprises Co and Mo on a support in an amount of less than a total of 12 wt. % calculated as the respective metal oxides CoO and MoO3 with a Co to Mo atomic ratio from 0.1 to 1.0.

6. A process according to claim 1 in which the olefin-retentive hydrodesulfurization is carried out in each stage at a temperature from 230 to 400° C., a pressure of from 400-34000 kPag, a space velocity of from 1-10 $v/v/hr^{-1}$ and with a space velocity in the second stage greater than that in the first stage.

7. A process according to claim 1 in which the blanketing gas contains $CO+CO_2$ at concentrations which result in concentrations of CO and/or $CO_2$ in the naphtha corresponding to a total concentration of CO and/or $CO_2$ in the treat gas of not more than 30 ppmw.

8. A process according to claim 1 in which the concentration of total $CO+CO_2$ in the blanketing gas is less than 0.4 vol %.

* * * * *